US006488025B1

(12) United States Patent
Cunningham

(10) Patent No.: US 6,488,025 B1
(45) Date of Patent: Dec. 3, 2002

(54) PORTABLE CAMPFIRE

(76) Inventor: Fred W. Cunningham, 7984 Crown Point St., Weidman, MI (US) 48893

( * ) Notice: Subject to any disclaimer, the term of this patent is extended or adjusted under 35 U.S.C. 154(b) by 0 days.

(21) Appl. No.: 09/902,234

(22) Filed: Jul. 10, 2001

(51) Int. Cl.[7] ..... F24C 3/04
(52) U.S. Cl. ..... 126/92 AC; 126/519; 126/92 R
(58) Field of Search ..... 126/92 R, 91, 126/9 R, 9 A, 9 B, 25 R, 25 A, 29.3, 41 R, 512, 519, 92 AC, 25 B; 431/328, 329

(56) References Cited

U.S. PATENT DOCUMENTS 4,903,683 A 2/1990 Larsen et al.
5,094,223 A 3/1992 Gonzalez
5,413,087 A 5/1995 Jean
5,421,321 A 6/1995 Ward
5,901,697 A 5/1999 Oliver, Jr. et al.
6,044,836 A 4/2000 Oliver, Jr. et al.

*Primary Examiner*—Sabrina Dagostino
(74) *Attorney, Agent, or Firm*—Reising, Ethington, Barnes, Kisselle, Learman & McCulloch PC

(57) ABSTRACT

The portable campfire includes a firebox with side walls, a bottom wall and an open top. A drip pan, with a floor that slopes downward and radially inward from a supporting ring to a discharge passage, is mounted in the firebox. A burner is mounted in the firebox above the drip pan floor. A fuel tank and fuel supply control valve are connected to the burner by a pipe. A log rack supports a plurality of artificial logs above the burner. A cooking rack is attachable to the log rack and has a plurality of cooking rack bars positioned above the artificial logs. A firebox cover is pivotally attachable to the firebox.

12 Claims, 4 Drawing Sheets

PORTABLE CAMPFIRE

TECHNICAL FIELD

The portable campfire has a container with a lid that houses artificial logs and a gas burner that is supplied with fuel from a small vessel.

BACKGROUND OF THE INVENTION

Camping and picnics often include a campfire. Many individuals enjoy sitting around a campfire and roasting marshmallows and hotdogs, especially in the evening when it becomes cool. A few individuals cook full meals on campfires.

During the fall football season, it has become popular to have a party and picnic before or after a football game in the parking lot near a football stadium. These parties permit families and friends to meet early before a game starts or after a game is over to socialize and eat together while others are on crowded roads trying to get to or from the game. It is frequently cold and some heat source would be welcomed even if there is no need to cook food.

Parks and wilderness areas frequently prohibit conventional campfires due to the danger of uncontrolled fires and for protection of the ecology. Parks and wilderness areas that permit conventional campfires generally require campers to bring their own wood to burn and prohibit the cutting or trimming of trees. Firewood is heavy, takes substantial space and is generally relatively expensive in camping areas. Conventional campfires cannot be used on paved parking lots due to possible damage to parking lot pavement.

Campfire devices are available that employ artificial logs and gas burners. People use these campfire devices in their backyards to avoid the need for firewood. They are also used to reduce the time required to start a conventional campfire and to reduce cleanup time. These campfire devices are intended to be stationary and are not easily transported.

SUMMARY OF THE INVENTION

The portable campfire includes a firebox. A drip pan with a drip pan floor is mounted in the firebox and has a discharge opening for directing accumulated drips out of the firebox. A burner is mounted in the firebox above the drip pan floor. A fuel supply tank and a fuel supply control valve are connected to the burner. A log rack is positioned in the firebox above the burner and is removable from the firebox. A plurality of artificial logs are supported above the burner by the log rack. A firebox cover is moveable between a closed position closing an open top of the firebox and an open position exposing the plurality of artificial logs for use.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
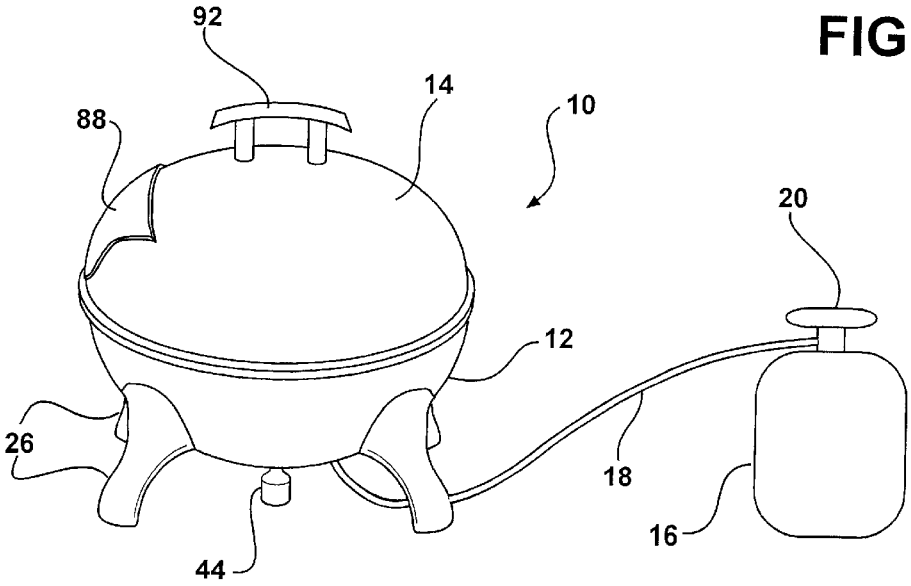
FIG. 1 is a perspective view of the portable campfire with a cover in the closed position and a gas container attached.

The portable campfire 10, as shown in the drawing has a firebox 12 and a cover 14. A cylinder or tank 16 supplies fuel to the firebox 12 through a pipe 18. The fuel in the cylinder 16 can be a gas such as propane or natural gas. The fuel can also be a liquid such as white gas or kerosene. The cylinder 16 is preferably made from a lightweight material with sufficient strength to safely contain the fuel. A valve 20 on the cylinder 16 controls the flow of fuel to the firebox 12.

The firebox 12 is a truncated hemisphere with an open top 22 and a flat bottom 24. The firebox 12 could be square, rectangular or any other desired shape. However, the hemispherical shape shown has a relatively large volume and minimizes the quantity of material required to make the box as well as the total weight. Aluminum or other lightweight material works well for the firebox 12. Users of the portable campfire 10 who are not concerned about weight can employ cast iron other high strength materials.

Legs 26 support the firebox 12 as shown in the drawing. The legs 26 can be lengthened or shortened or they can be eliminated. When the legs 26 are eliminated, the flat bottom wall 24 supports the firebox 12.

Figure 4:
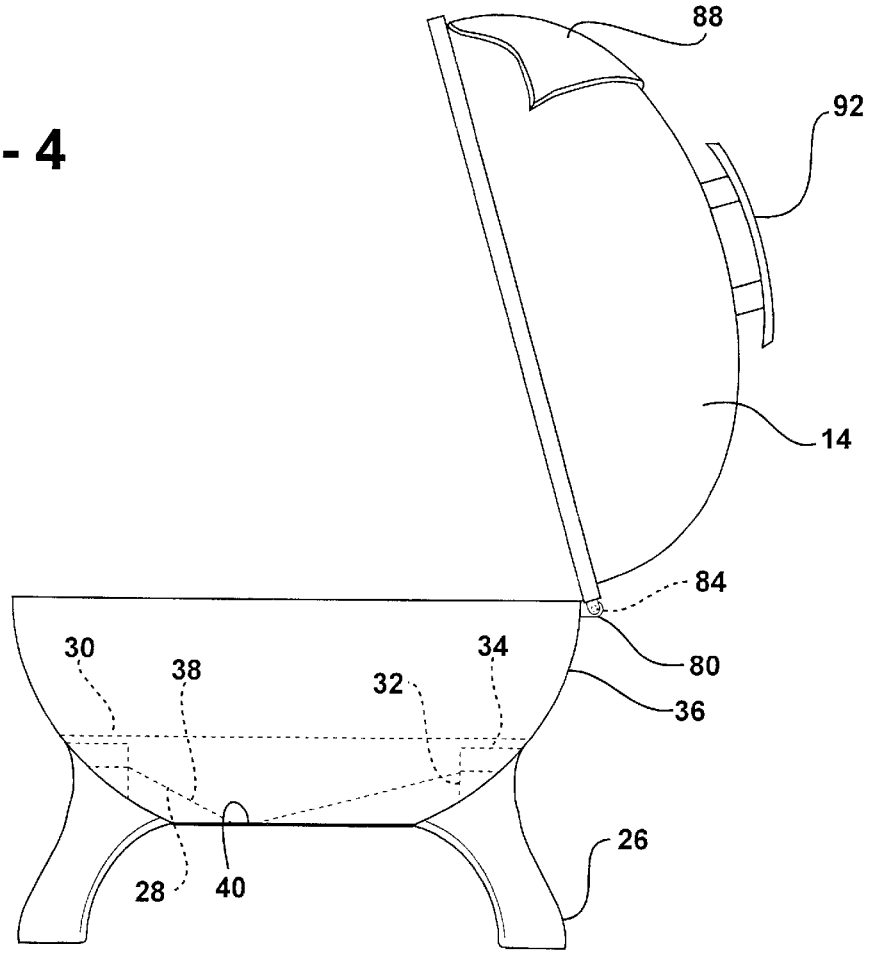
FIG. 4 is a side elevational view with the cover open.
Figure 5:
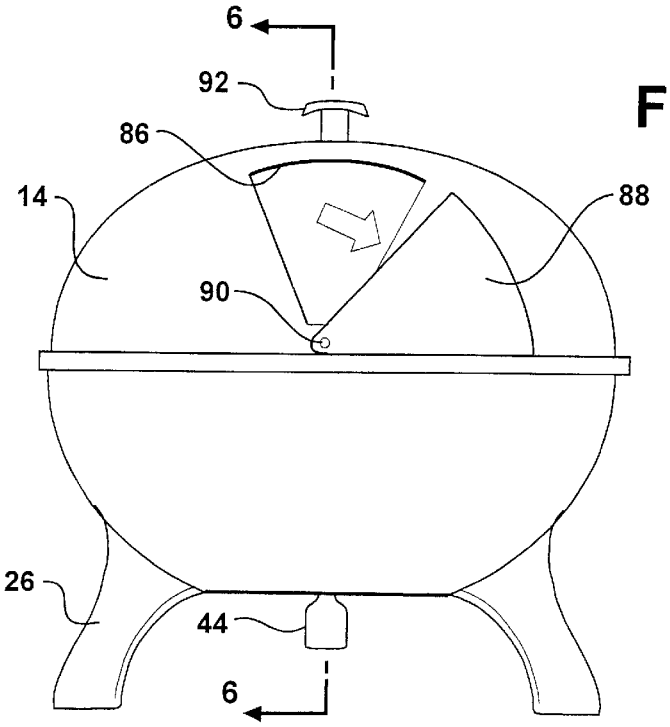
FIG. 5 is a front elevational view of the portable campfire with the cover closed.
Figure 6:
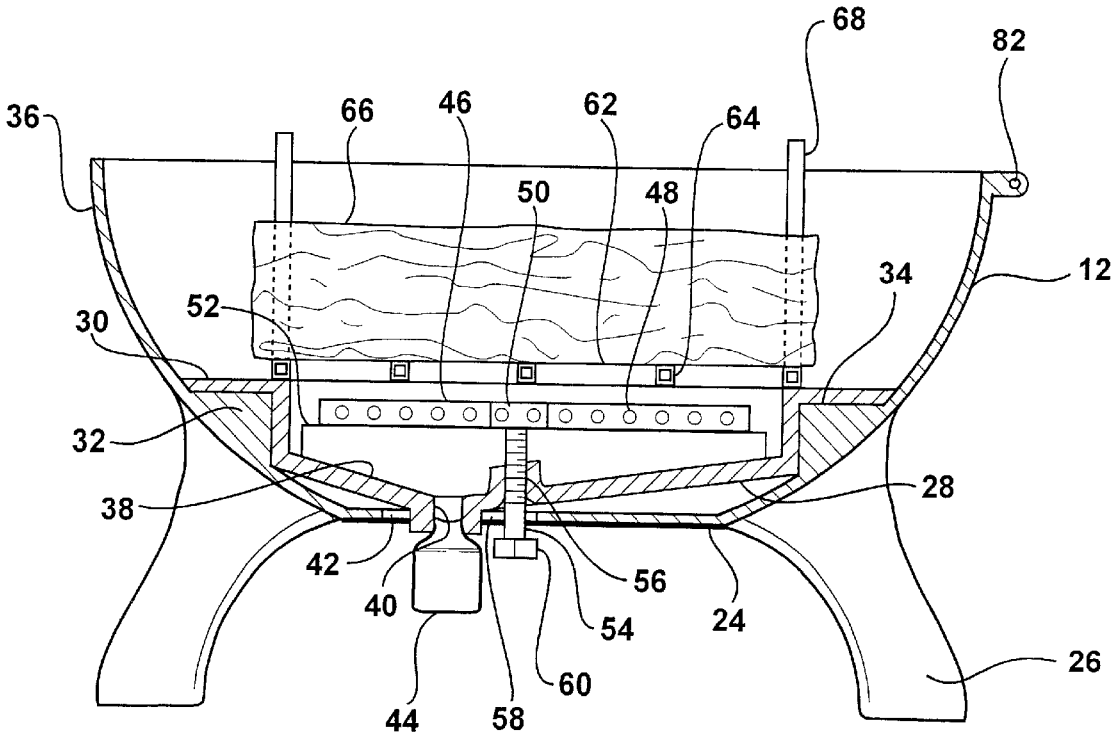
FIG. 6 is an enlarged sectional view of the portable campfire, with the cover removed, taken along line 6—6 in FIG. 5.

A drip pan 28 is shown in FIGS. 4 and 5. The drip pan 28 has a top support ring 30 that sits on a ledge 32 with a horizontal top surface 34. The ledge 32 is integral with the wall 36 of the firebox 12. The floor 38 of the drip pan 28 slops downward to a discharge opening 40. Discharge opening 40 is in alignment with a passage 42 through the flat bottom 24. A drip catch container 44 is attached to the floor 38 adjacent to the discharge opening 40 and catches anything that passes through the discharge opening. The drip catch container 44 is removed from the drip pan 28 for disposal of its contents and then reattached to the drip pan to catch additional material.

The drip pan 28 is preferably welded to the wall 36 of the firebox 12. However, the drip pan 28 can be a separate member that is removable from the firebox if desired. In addition to catching drips, if any drips are produced to be caught, the drip pan 28 reduces the temperature of the flat bottom 24.

A burner 46 has gas passages 48 along the edges of the four burner legs 50. A burner support 52 on the outer free end of each burner leg 50 sets on the top of the floor 38 of the drip pan 28. The gas and air inlet pipe 54 extends downward from the center of the burner 46 and passes through a passage 56 through the drip pan 28 and a passage 58 through the flat bottom wall 24 of the firebox 12. The pipe 18 is connected to the coupler 60 on the bottom of the pipe 54. If a liquid fuel is used the inlet pipe 54 may not let air into the burner 46. After the pipe 18 is disconnected from the coupler 60, the burner 46 can be lifted vertically out of the firebox 12 for cleaning and maintenance. Fasteners are not necessary to hold the burner 46 in place. However, fasteners can be employed if desired to secure the burner 46.

Figure 2:
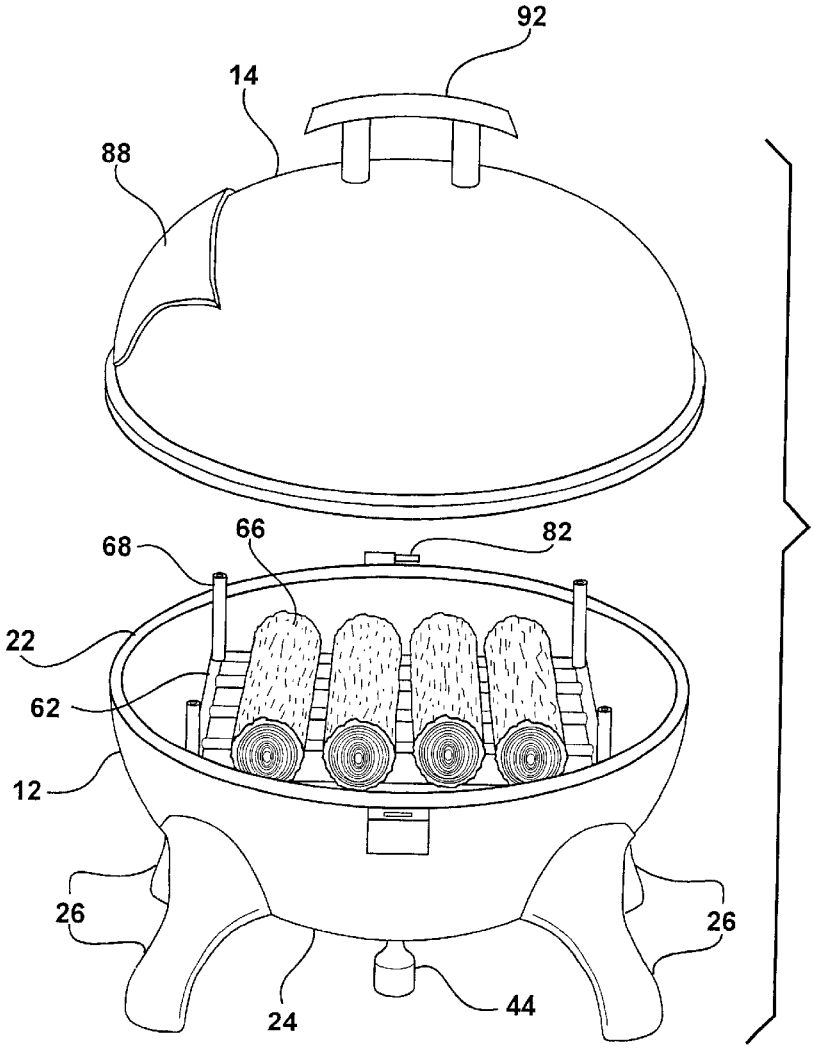
FIG. 2 is an expanded perspective view of the portable campfire with the cover removed and without a gas container.

A log rack 62 sets on the top support ring 30 of the drip pan 28 and is above the burner 46. The log rack 62 includes a plurality of horizontal bars 64 that support artificial logs 66. Four logs 66 are supported by the horizontal bars 64 as shown in FIG. 2. An additional layer of logs can be placed on top of the logs 66 if desired. The additional layer of logs 66 would preferably be oriented transverse to the first layer.

A third layer of logs 66 could be placed on top of the second layer if desired.

The log rack 62 has vertical post members 68 on each of the four corners. These vertical posts 68 extend upward from the horizontal bars 64 and keep logs 66 from rolling off the rack 62 and possibly into contact with the wall 36 of the firebox 12.

A cooking rack 70 has a plurality of horizontal bars 72 which support pots and pans or form a grill that will support foods that are to be cooked by direct exposure to heat and fire. Four vertical posts 74 extend vertically downward from the corners of the cooking rack 70. During use of the cooking rack 70, the vertical posts 74 set on top of the post members 68 of the log rack 62. The posts 68 have vertical bores 76 that receive alignment pins 78. The alignment pins 78 maintain horizontal alignment between the posts 68 and the posts 74. These posts 68 and 74 hold the horizontal bars 72 above the logs 66. Sleeves rather than alignment pins 78 could be used to receive the posts 68 and 74. A height adjustment for the cooking rack 70 could also be provided if necessary.

The cover 14 is pivotally attached to the firebox 12 by a hinge assembly 80 shown in FIG. 5. The hinge assembly 80 includes pivot pin 82, connected to the firebox 12, that is received in a bore in a hinge bracket 84 connected to the cover 14. By moving the cover 14 to one side relative to the firebox 12, the hinge block 84 disengages from the pivot pin 82 and the cover 14 is disengaged from the firebox. The primary function of the cover 14 is to cover the firebox 12 when the portable campfire is not in use. Camp fires are not normally covered. Covering logs 66 when the campfire 10 is not in use keeps the unit clean. The cover 14 also keeps flammable materials from contacting the logs 66 during transport while permitting the logs to cool.

A vent opening 86 in the cover 14 is shown in FIG. 5. An adjustable vent opening lid 88 is pivotally attached to the cover 14 by pin 90. This lid 88 is held in any selected position between fully open and fully closed by friction. Providing a vent opening 86 is an optional feature. A vent opening 86 will not be provided in the cover 14 of the portable campfire 10 that is used only for camp fires with artificial logs. A handle 92 is provided for opening and removing the cover 14. The handle 92 is also used to replace the cover 14 and close the open top 22 of the firebox 12.

Figure 3:
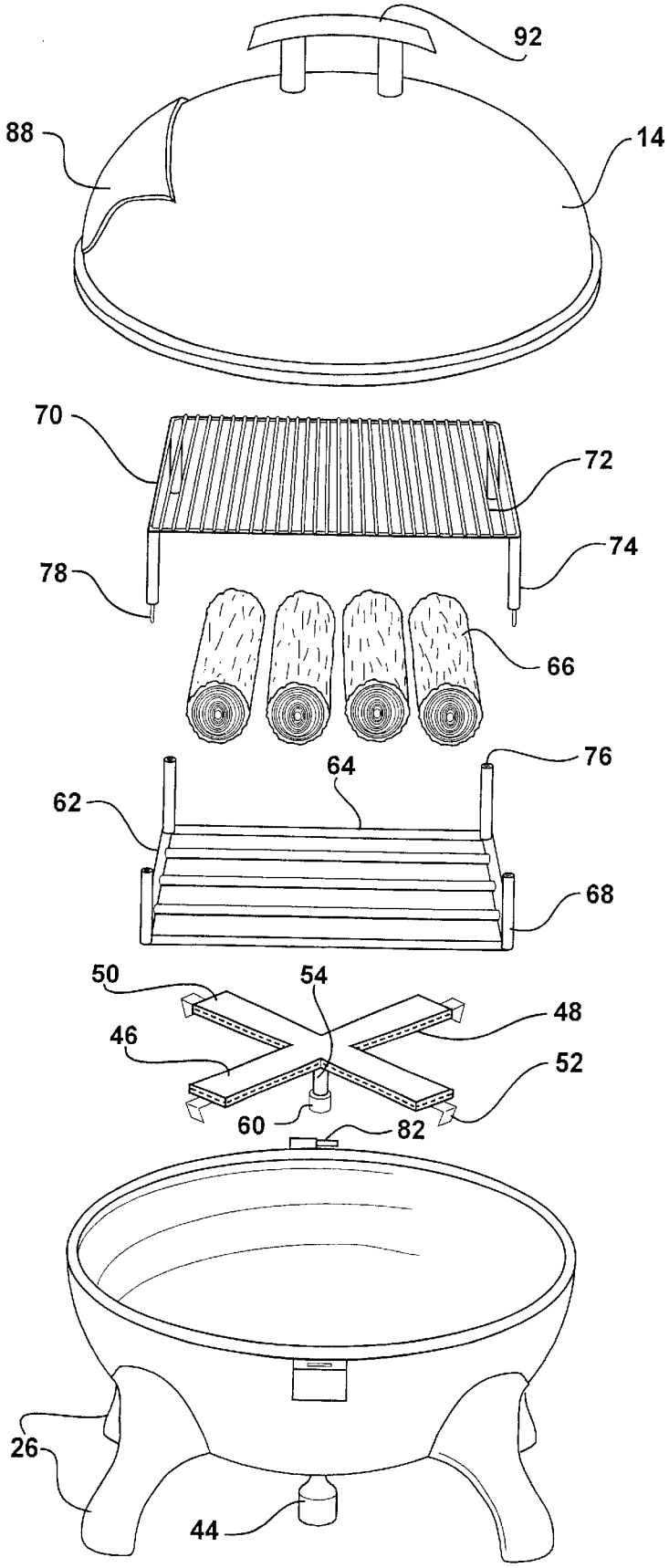
FIG. 3 is an expanded view of the portable campfire including an optional grill for cooking.

Handles 94 can be provided on the firebox 12, as shown in FIG. 3, if needed. For a large portable campfire 10, more than two handles 94 can be attached to the firebox 12. The legs 26 can be used as handles on small units.

During use of the portable campfire 10, the cover 14 is pivoted to an open position. Usually the cover 14 will also be removed from the firebox 12. However, the cover 14 can remain pivotally attached to the firebox 12 if desired. The cylinder 16 with fuel is connected to the burner 46. The valve 20 is opened to supply fuel to the burner 46 and the burner is lit with a match or other igniter. The log rack 62 is positioned above the burner 46 and artificial logs 66 are placed on the rack. One or more layers of logs 66 can be used as explained above. The cooking rack 70 can be mounted on the log rack 62 or left off if it is not needed. The valve 20 is adjusted as required to control the fire.

The campfire 10 is shut off by closing the valve 20. The artificial log 66 and the firebox 12 are permitted to cool for a few minutes. After the unit has cooled, the lid is reattached to the pivot pin 82 and moved to a closed position. The drip catch container 44 is removed, emptied and reattached to the firebox 12. If the portable campfire 10 is to be moved, the cylinder 16 is disconnected from the burner 46.

The disclosed embodiment is representative of a presently preferred form of the invention, but is intended to be illustrative rather than definitive thereof. The invention is defined in the claims.

I claim:

1. A portable campfire comprising:

a firebox;

a drip pan with a drip pan floor mounted in the firebox;

a burner mounted in the firebox above the drip pan floor;

a fuel supply tank and a fuel supply control valve connected to the burner;

a log rack positioned in the firebox above the burner;

a plurality of artificial logs supported above the burner by the log rack; and a firebox cover moveable between a closed position closing an open top of the firebox and an open position exposing the plurality of artificial logs for use.

2. A portable campfire, as set forth in claim 1, wherein the firebox includes side walls, a bottom wall and an open top.

3. A portable campfire as set forth in claim 1, wherein the drip pan floor slopes downward and radially inward to a discharge opening that directs accumulated drips out of the firebox.

4. A portable campfire, as set forth in claim 3, wherein the drip pan is fixed to the firebox.

5. A portable campfire, as set forth in claim 4, wherein the firebox has a bottom wall below the drip pan.

6. A portable campfire, as set forth in claim 1 wherein the burner sits on the drip pan.

7. A portable campfire, as set forth in claim 1, including a cooking rack with horizontal cooking rack bars attached to the log rack and wherein the horizontal cooking rack bars are positioned above the plurality of artificial logs.

8. A portable campfire comprising;

a firebox with a side wall, a bottom wall and an open top;

a drip pan with a drip pan floor mounted in the firebox above the bottom wall and having a discharge opening for directing accumulated drips out of the firebox;

a burner mounted in the firebox above the drip pan floor;

a fuel supply tank and a fuel supply control valve connected to the burner by a pipe;

a log rack with a plurality of horizontal log support bars and vertical log retainer bars;

a plurality of artificial logs supported above the burner by the log rack and retained between the vertical log retainer bars; and a firebox cover pivotally attached to the firebox and movable between a closed position closing the open top of the firebox and an open position exposing the plurality of artifical logs for use.

9. A portable campfire, as set forth in claim 8, wherein the drip pan floor slopes downward and radially inward to the discharge opening.

10. A portable campfire, as set forth in claim 1 wherein the burner sits on the drip pan floor.

11. A portable campfire, as set forth in claim 8, including a cooking rack attached to the log rack and wherein the cooking rack includes a plurality of horizontal cooking rack bars that are positioned above the plurality of artificial logs.

12. A portable campfire, as set forth in claim 8, wherein the drip pan is fixed to the side wall of the firebox.

* * * * *